United States Patent [19]

Jacobs

[11] 4,116,267

[45] Sep. 26, 1978

[54] MODULAR INTEGRATED COOLING AND HEATING SYSTEMS FOR EFFLUENTS AND OTHER USES

[76] Inventor: Herbert V. Jacobs, 301 Chestnut St., Apt. 1005, Harrisburg, Pa. 17101

[21] Appl. No.: 857,067

[22] Filed: Dec. 5, 1977

[51] Int. Cl.[2] ..... F28C 3/04; F28B 9/00

[52] U.S. Cl. ..... 165/110; 60/688; 60/692; 165/45

[58] Field of Search ..... 165/45, 110; 60/688, 60/689, 690, 692

[56] References Cited

U.S. PATENT DOCUMENTS

| | | | |
|---|---|---|---|
| 3,204,692 | 9/1965 | Smith | 165/110 |
| 3,788,385 | 1/1974 | Delahunty | 60/690 |
| 3,820,334 | 6/1974 | Heller et al. | 60/688 |
| 3,937,973 | 2/1976 | Weber et al. | 165/45 |
| 4,009,577 | 3/1977 | Allen | 165/45 |
| 4,052,858 | 10/1977 | Jeppson | 60/688 |

*Primary Examiner*—Charles J. Myhre
*Assistant Examiner*—Sheldon Richter
*Attorney, Agent, or Firm*—Caesar, Rivise, Bernstein & Cohen, Ltd.

[57] ABSTRACT

A modular integrated cooling and heating system for effluents and other uses involving mixing tanks connected in series, hot water supply pipes connected to each of the mixing tanks in order to convey to each mixing tank a portion of the hot water effluent from a power plant. Cooling water pipes are connected to each of said mixing tanks in order to deliver cooling water from a river or other source to said mixing tanks whereby hot and cooling water mixes in said first tank with the water mixture being continuously passed into said second tank for mixing with additional cooling water from a cooling water pipe. The number of stages or mixing tanks will vary depending upon the cooling capacity desired.

In another embodiment of the invention, the hot water effluent conveyed to the first tank is not allowed to mix with the cooling water, but instead of the hot water effluent runs through convoluted piping in said first tank and is then discharged into said second tank with the remainder of the system being identical. This is the so-called co-generation modification utilizing hot effluent water which contains undesirable chemicals. In this co-generation modification the local water supplied by the water company or other utility is heated by contacting the hot walls of the convoluted piping and such heated water is then pumped in the uncontaminated state to homes or similar use.

9 Claims, 14 Drawing Figures

MODULAR INTEGRATED COOLING AND HEATING SYSTEMS FOR EFFLUENTS AND OTHER USES

This invention relates to modular integrated cooling and heating systems for effluents and other uses.

The problem of disposing of hot water effluents from power plants is presenty recognized as a most serious one for many reasons including the undesirable effects existing from the heating of river water by the dumping into the river of large volumes of heated water.

The response to the river water heating problem has been to erect large and expensive cooling towers which did not always operate well, particularly in the summer. Such establishments have proved to be expensive to operate and because of such expense there has been an added burden imposed upon the building facilities like atomic power plants, or fossil fuel fired power plants.

Moreover, such establishments have been relatively inefficient particularly in the warm weather wherein it is not feasible to bring the effluent water temperature below the temperature of the ambient air.

Most of the foregoing cooling establishments have operated upon well-recognized principles of evaporative cooling which normally work well for relatively small volumes of air and water, but which cannot be readily extrapolated up to tanks of a size of 10 million gallons or more, particularly in warm weather.

Another consideration is that the disposal of large volumes of heated water constitutes an enormous loss of energy. Thus, the evaporative coolers, when working properly, at best serve as a means to dispose of precious energy which should be put to work for other sources.

With cooling towers the water is evaporated creating large volumes of water vapor which rise into the atmosphere. In a 1,000 mega-watt facility, as much as 20,000,000 gallons of water are evaporated each day. This has created a situation whereby the river basin commissions have ordered the utilities to provide make-up water for each plant by constructing large reservoirs. Each reservoir will take up to 6,000 acres of land and add a cost of up to 100 million dollars which will be passed on to the consumer.

Another undesirable element of cooling towers is the possibility of meterological disturbance caused by the plumes of water vapor, especially where four or more cooling towers are located on one site. In a coal-fired plant this can cause acid rain from a combination of $SO_2$ emissions from the stack and the water vapor which is detrimental to agriculture in the area.

The differential in cost is as follows. For a 1,000 mega-watt plant two cooling towers will cost 20 million dollars. To this is added the land, dams, pumping equipment etc. for make-up water costing about 100 million dollars. The total cost is 120 million dollars. With the present invention even ten cooling and mixing towers costing 1.5 million dollars each will make for a total cost of only 15 million dollars, thereby saving 105 million dollars.

Accordingly, the present invention constitutes the provision of a system whereby substantial portions of the heat content from the hot water effluent of power plants and other sources is efficiently transferred in order to achieve the two-fold purpose of cooling the hot water effluents as well as re-directing a subtantial portion of its heat toward useful purposes.

In particular, the present invention involves the establishment of a modular integrating cooling and heating system of variable size depending upon the particular needs. It is understood that the present invention while directed toward hot water effluents in power plants, for the purpose of disclosing a specific embodiment, in reality is usable with any type of hot water in general. It should be kept in mind that the effluents from a power plant will sometimes contain undesirable dissolved salts and chemicals, such that additional treatment is necessary in accordance with well known principles.

The present invention basically comprises a plurality of mixing tanks connected together in series with the raw hot water effluent being supplied to the middle of the first mixing tank. In the first embodiment of the invention cold water from a river or other source is led by cold water pipes to the top of each of the mixing tanks. In the first mixing tank the cold and hot water sources are blended and then fed to the center of the second mixing tank where additional cold water is delivered to further mixing, cooling and transportation to the third tank and so on. The goal is to come as close as possible to source water.

In another embodiment of the invention the so-called co-generation principle is used in the first tank wherein the hot water is not allowed to mix with the cooling water. Instead, the hot water effluent runs through convoluted piping in the first tank in a type of heat exchanger arrangement. Thus, the good quality cooling water from the local water company is allowed to circulate and contact the outer surface of the heated convoluted piping such that the cooling water itself is heated and then distributed to homes or other uses. The now somewhat cooled effluent water in the convoluted piping is delivered to the second tank for direct mixing with cold water from a river or other source and continuation of the present system for as many stages or tanks as may be desired.

Other objects and many of the attendant advantages of this invention will be readily appreciated as the same becomes better understood by reference to the attached figures of drawings wherein.

Figure 1:
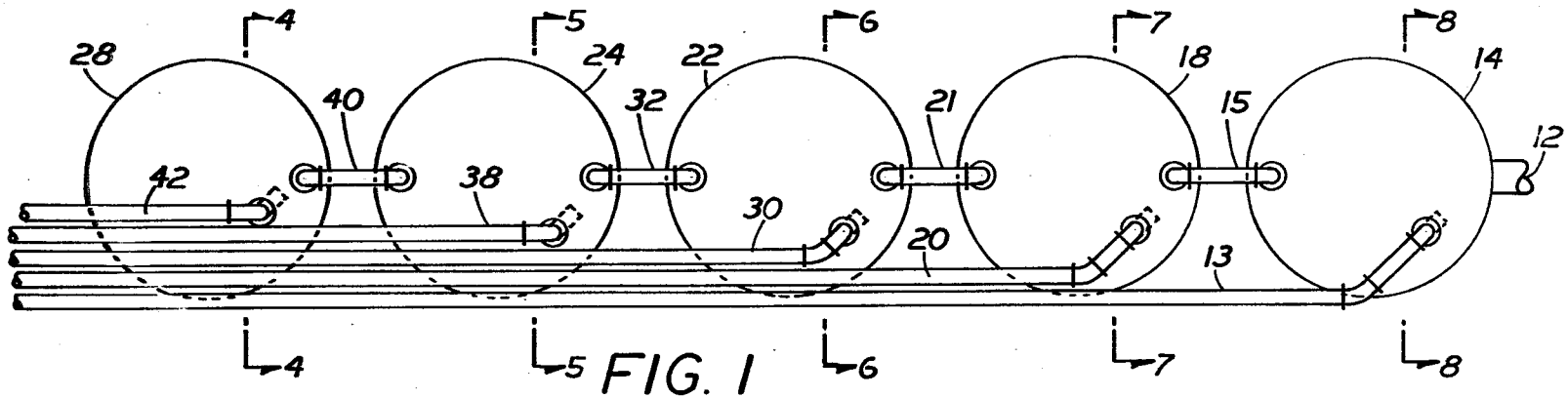
FIG. 1 is a plan view showing five tanks connected together in series in a first embodiment of the invention.
Figure 2:
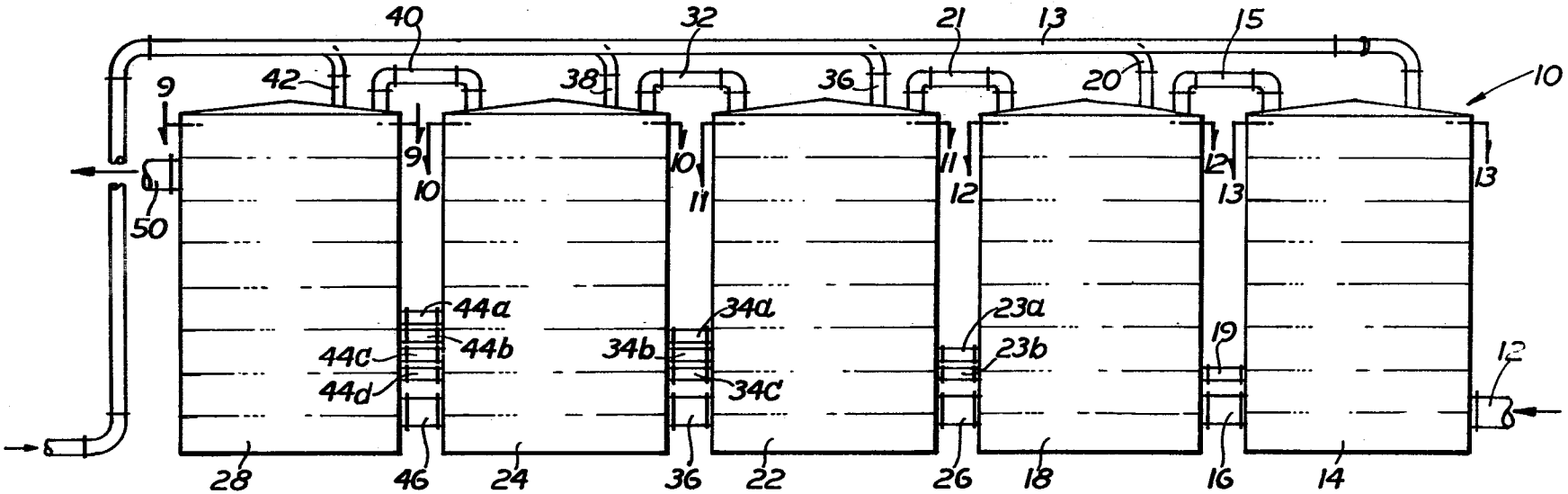
FIG. 2 is an elevational view of the system shown in FIG. 1.
Figure 3:
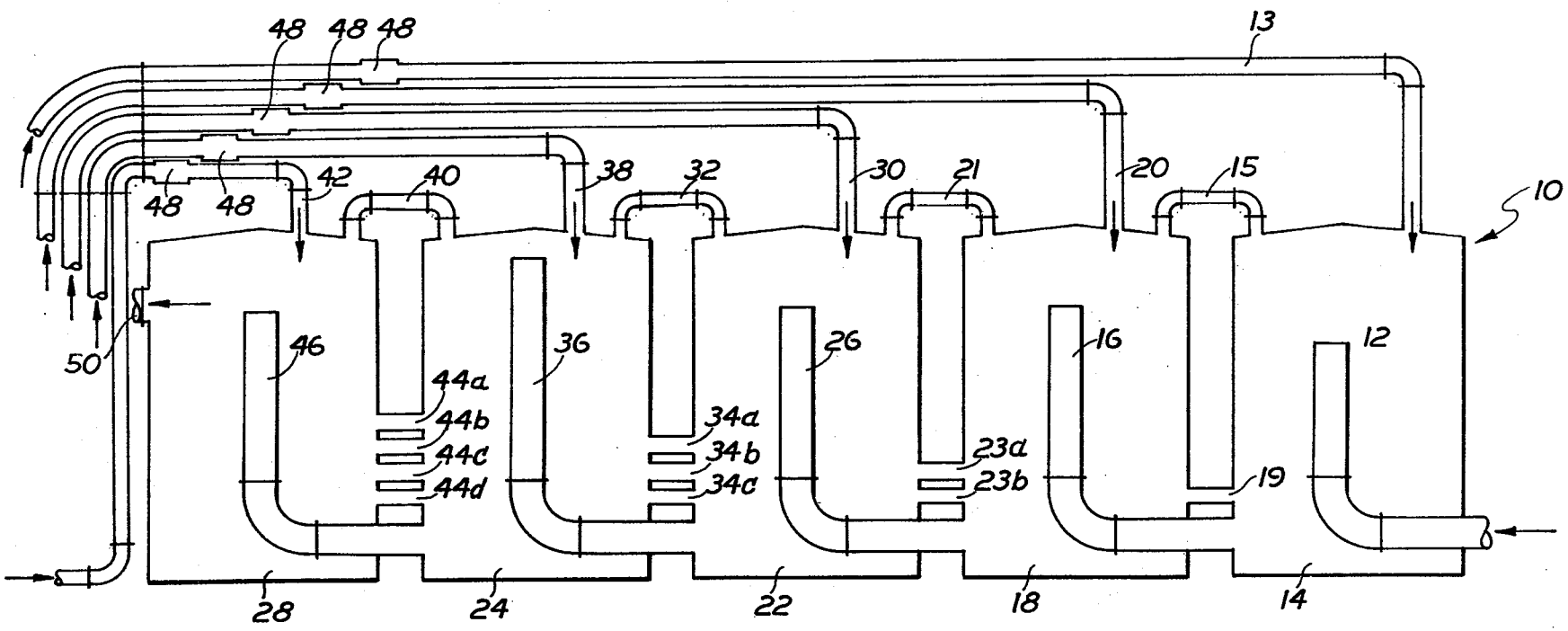
FIG. 3 is a vertical section taken through the system of FIG. 2 in order to disclose the various piping and connections in the system.
Figure 5:
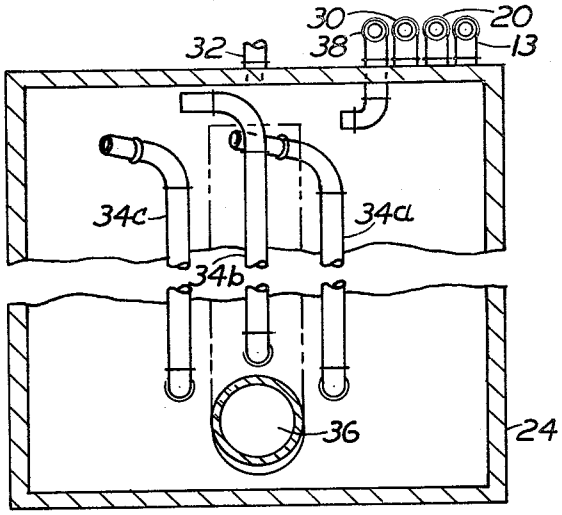
Figure 8:
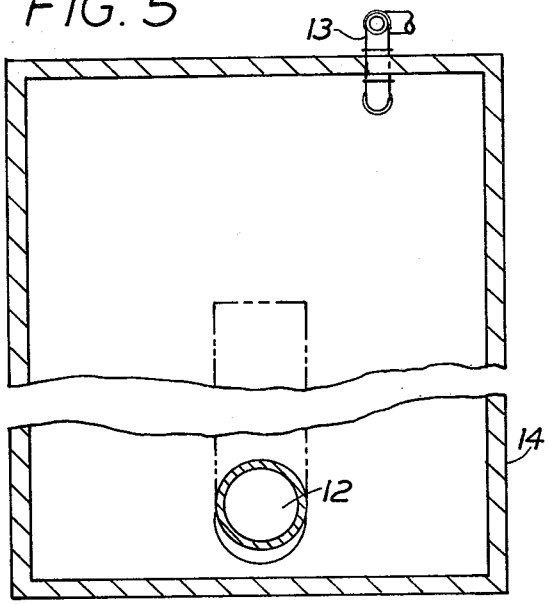
Figure 6:
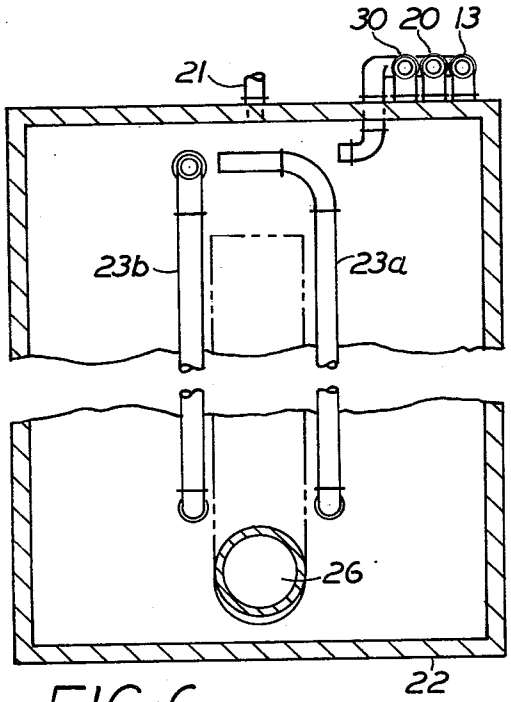
Figure 4:
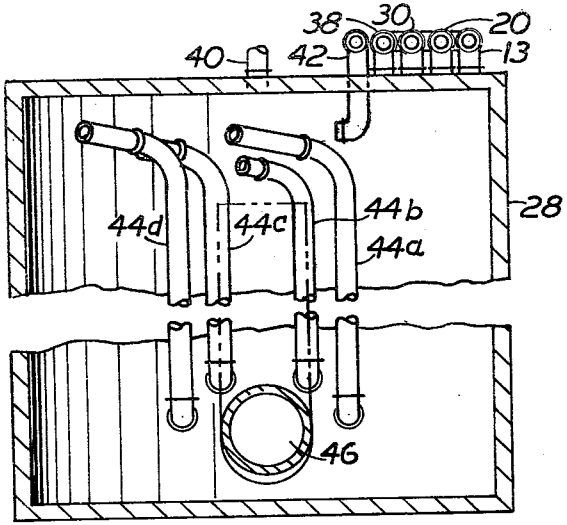
Figure 7:
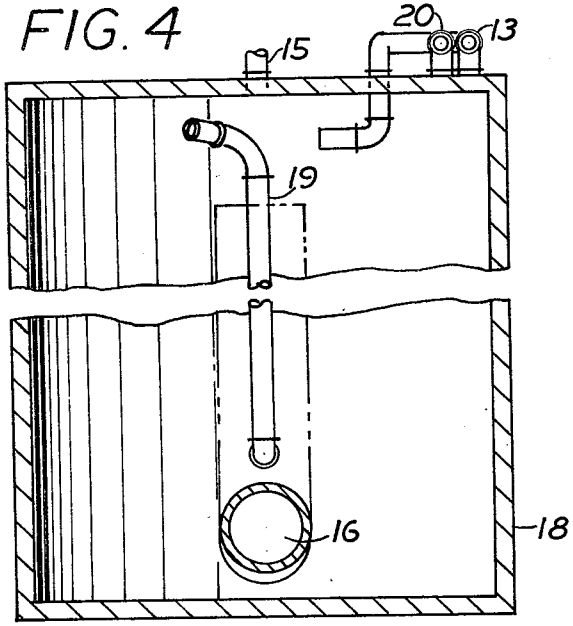
Figure 10:
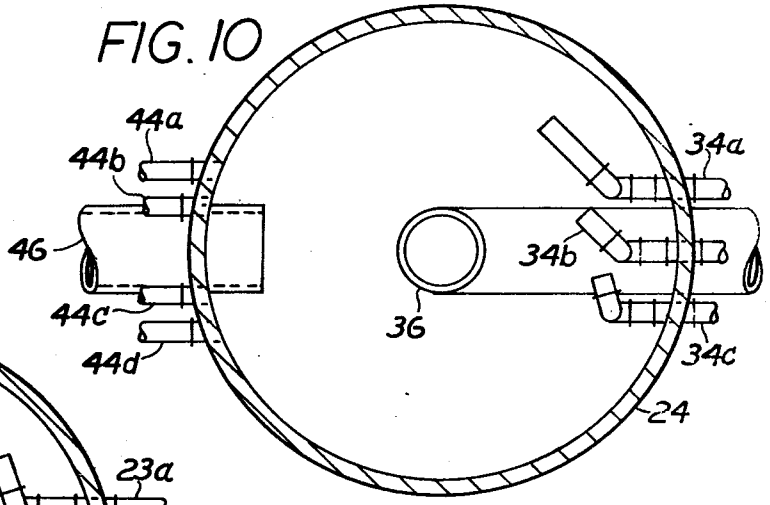
Figure 13:
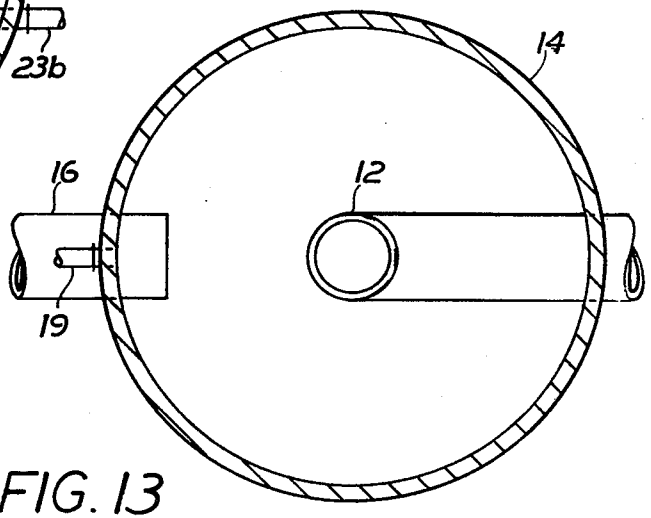
Figure 11:
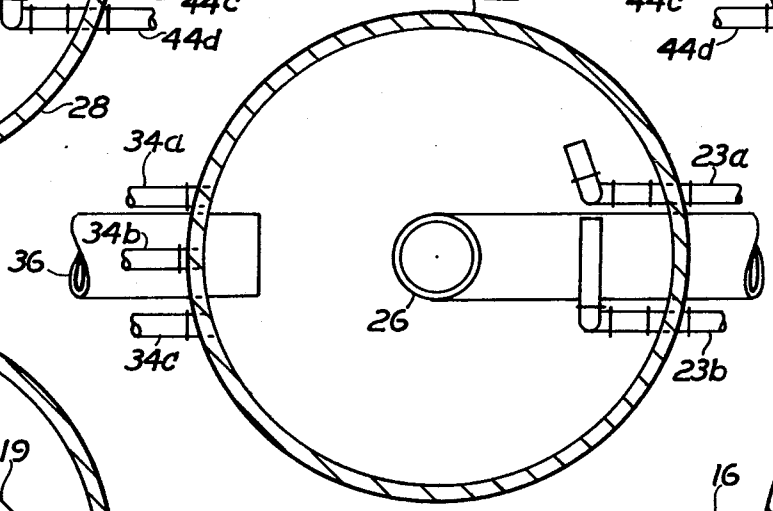
Figure 9:
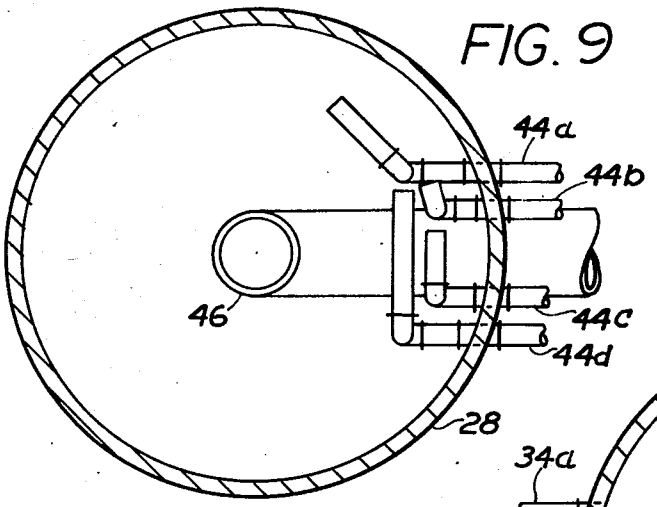
Figure 12:
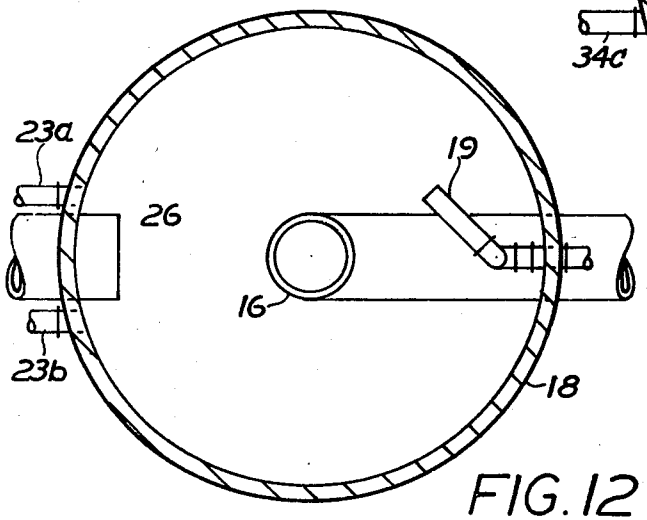
Figure 14:
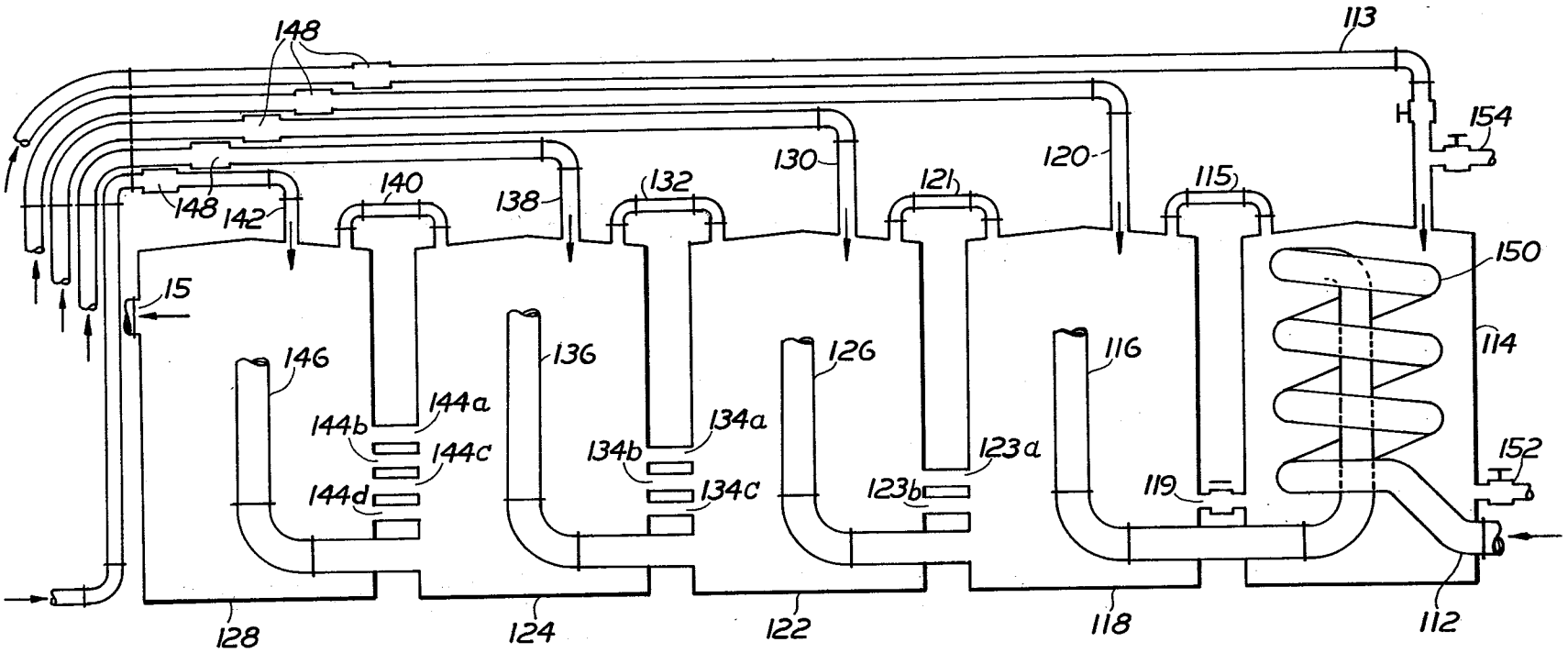

FIGS. 4, 5, 6, 7 and 8 are respectively vertical sections taken in the opposite sense from the vertical section of FIG. 3 along the lines 4—4, 5—5, 6—6, 7—7 and 8—8 of FIG. 2;

FIGS. 9, 10, 11, 12 and 13 are respectively horizontal sections taken along the lines 9—9, 10—10, 11—11, 12—12 and 13—13 of FIG. 2; and FIG. 14 is a view similar to FIG. 3 showing another embodiment of the invention involving the co-generation construction in the first tank.

Referring now in greater detail to the various figures of the drawing wherein like reference characters refer to like parts, there is shown largely at 10 in FIGS. 2 and 3 a modular integrated cooling and heating system embodying the present invention. As shown in FIGS. 2 and 3 there are a plurality of mixing tanks 14, 18, 22, 24 and 28 connected together in series. The hot water effluent from a power plant or other source is delivered to the middle of mixing tank 14 through hot water pipe 12. Cooling water from a river or other source is conveyed to tank 14 through pipe 13. It will be observed that the hot water and cooling water are mixed together in tank 14 and then are pumped or otherwise transfered by way of pipe 16 into second mixing tank 18. Air vent connection 15 is provided to allow the aforesaid transfer of liquid. Also, overflow passage 19 is provided between tanks 14 and 18 to compensate for any pressure buildup occurring due to the excessive introduction into tank 14 of volumes of water from either pipe 13 or pipe 12.

In second mixing tank 18 it will be seen that the somewhat cooled water from tank 14 is fed to the middle of tank 18 by pipe 16. Additional cooling water is fed to second tank 18 through pipe 20. An air vent pipe 21 is provided between second tank 18 and third tank 22 for the identical purpose as pipe 15. Also, two overflow passages 23-*a* and 23-*b* are provided between the tanks 18 and 22 to compensate for additional volumes of water from cooling pipes 13 and 20 and effluent pipe 12.

It will be seen that the modular system proceeds through five stages as illustrated in FIGS. 2 and 3 with comparable reference numerals being placed on the various tanks. The overflow passageways between the tanks are provided as needed. It is also to be understood that the hot effluent water is delivered to the first tank through appropriate piping and pumps and that the various cooling water pipes as shown in the figures of the drawings include pumping systems (such as pumps 48 — FIG. 3) in order to deliver the river or other cooling water to the various tanks. Also, where needed pumps may be employed in order to move the volumes of mixed water between the various tanks.

In an actual test carried out on a small scale model, the cooling water was fed into the system at 83° F (28° C). The effluent river is delivered through pipe 13 to tank 14 at a temperature of 127° F (52° C). Because of the larger volume of cooling water delivered to tank 14, the resulting temperature of the mixed water in tank 14 was 116° F (46° C). In the second stage, the mixed water had a temperature of 103° F (39° C). In the third stage or tank, the mixed water had a temperature of 96° F (35° C). In the fourth stage, the mixed water had a temperature of 92° F (33° C). In the fifth stage, the mixed water had a temperature of 89° F (31° C). Obviously, the various resulting temperatures will change depending upon the volume of hot and cooling water, but the concept of mixing achieved through the present invention reduces the tremendous expense of evaporative coolers that are currently in use.

Referring particularly to FIGS. 2 and 3 it will be seen that transfer pipe 26 permits the passage of water from the second mixing tank 18 to the third mixing tank 22. It will be seen that the transfer pipe 26 delivers water from the lower part of tank 18 to the upper part of tank 22 in order to achieve a maximum cooling action. Pumping means (not shown) can be used to assist the upward passage of liquid through transfer pipe 26 as well as any of the other transfer pipes 12, 16, 36 and 46.

From FIG. 3 it can be seen that cooling water is fed to third tank 22 through pipe 30. An air vent 32 is provided connecting third tank 22 and fourth tank 24. Three overflow passages 34-*a*, 34-*b* and 34-*c* are provided between third tank 22 and fourth tank 24.

With reference to tank 24 it will be seen that transfer pipe 36 conveys mixed water from the bottom of third tank 22 to the top of fourth tank 24. Cooling water is introduced into fourth tank 24 through pipe 38. Venting between fourth tank 24 and fifth tank 28 is achieved through vent 40.

Cooling water is introduced into fifth tank 28 through pipe 42. There are four overflow passages 44-*a*, 44-*b*, 44-*c* and 44-*d* between fourth tank 24 and fifth tank 28. Mixed water is conveyed from the bottom of fourth tank 24 to the top of fifth tank 28 through transfer pipe 46.

As can be further seen in FIG. 3 cooling water is pumped to the various tanks through pipes 13, 20, 30, 38 and 42 with the assistance of pumps 48. The final effluent is obtained through piping 50 from fifth tank 28. This effluent will be considerably cooled and can be disposed in a stream or river, following chemical treatment for removal of undesirable substances where desired.

Referring now to FIG. 14 it will be seen that the system in FIG. 14 is essentially identical to FIG. 3 except for the first tank 114 wherein the hot water effluent is not permitted to mix with the cooling water. Instead, the hot water effluent is circulated by piping 112 through convoluted piping 150 and then passed to tank 118 through pipe 116. Starting with the second tank 118 the system of FIG. 14 is identical with FIG. 3. It will be appreciated that the hot water effluent in convoluted piping 150 will be cooled somewhat whereas the cooling water delivered to tank 114 through pipe 113 is heated to a degree as may be controlled by the relative volumes of the hot water in convoluted piping 150 and cooling water as fed through piping 113. In any event, the cooling water fed through piping 113 is heated to the desired degree and then is drawn off through tap 152 for home heating purposes or other use. In this way the cooling water is not contaminated by the impurities in the heated water effluent that is fed to convoluted pipe 150. As sown in FIG. 14, the system is flexible to accept cooling water from the local water company which is then returned through tap 152 in a warm condition.

In one embodiment of the invention once tank 114 is filled, no more water will enter the tank unless the water already in the tank has been drawn off for heating and hot water use for homes and industry. This is a so-called batch process which, while slow, will achieve a hotter temperature in the water.

Referring again to FIG. 14 it will be seen that the five mixing tanks are tanks 112, 118, 122, 124 and 128. Appropriate vent connections 115, 121, 132 and 140 are provided. The somewhat cooled water passes from tank 114 to tank 118 through tranfer pipe 116. Other transfer pipes 126, 136 and 146 are provided as well as the various overflow passages between the respective tanks which are identified as 119, 123-*a*, 123-*b*, 134-*a*, 134-*b*, 134-*c*; and 144-*a*, 144-*b*, 144-*c*, and 144-*d*. The final effluent is obtained through piping 151 from fifth tank 128 and such effluent can then be disposed of.

As further seen in FIG. 14 the cooling water is fed to the respective mixing tanks through pipes 113, 120, 130, 138 and 142. Where desired, appropriate pumps may be used in conjunction with the cooling water pipes or with the transfer pipes or with any other aspect of the system as well as may readily occur to those skilled in the art. Where desired, water of acceptable properties may be delivered through valve 154 to pipe 113. Such water passing through valve 154 may originate through the the local water supply of a local water utility.

From the foregoing, it can be seen that in the second embodiment of the invention the first mixing tank is constructed to obtain the heat content of the effluent from the power plant while preventing contamination of the water that is fed to the first mixing tank for purposes of obtaining a portion of the heat content of the self-contained effluent that circulates through the first mixing tank. Such self-contained effluent is then fed to the second mixing tank and as shown in FIG. 14 may be freely mixed with the cooling water. Clearly, it is contemplated that such effluent may be maintained in a self-contained or closed circuit condition through the second, third or any number of tanks in the manner of the first mixing tank. Also it is to be understood that while the present invention is disclosed as having five mixing tanks, that the number of mixing tanks will vary with the volume of water involved or the heat load to be transferred as will occur to those skilled in the art.

It should be kept in mind that the present invention affords the following additional advantages:

1. The elimination of salinity intrusion into the river caused by blowdown of cooling towers since there is no evaporation.
2. The elimination of cost of reservoirs for make-up water during periods of low flow.
3. The elimination of removal of prime agricultural land for reservoir, displacement of homes and businesses, and danger of dam burst and resultant flooding.
4. The elimination of so-called water shortage areas for power plant since no water is consumed and there is no thermal discharge.
5. Separate pumps for each tank would be thermostatically controlled to achieve the desired temperature in each tank by pumping more or less cooling water.
6. The system will open the door for construction of nuclear energy centers. Since no water is evaporated there will be no danger of changes in meterological conditions.
7. During periods of low flow or draught, power plants can continue operating since no water is consumed.
8. The elimination of noise caused by cooling towers.

Without further elaboration the foregoing will so fully illustrate my invention that others may, by applying current or future knowledge, readily adapt the same for use under various conditions of service.

What is claimed as the invention is:

1. A modular integrated cooling and heating system comprising a plurality of at least two mixing tanks connected together, the first of said mixing tanks being provided with hot water supply means to deliver hot water to said mixing tank, cooling water supply means to deliver cooling water to said tank for direct mixing with said hot water to obtain water at a first intermediate temperature, second supply means to transport said intermediate temperature water to said second mixing tank, and second cooling water supply means to deliver water to said second mixing tank for direct mixing with said first intermediate temperature water to obtain water at a second intermediate temperature whereby said hot water is cooled by direct mixing with said cooling water to avoid the necessity of evaporative cooling towers.

2. The Modular Integrated Cooling and Heating System of claim 1 wherein said supply means extend upwardly into said mixing tanks to a point above the geometric center thereof to deliver the hot water at a relatively high point in the mixing tank.

3. The Modular Integrated Cooling and Heating System of claim 1 wherein said cool water supply means enter at the top of each mixing tank.

4. The Modular Integrated Cooling and Heating System of claim 1 wherein said hot water is obtained from the effluent of a power plant.

5. The Modular Integrated Cooling and Heating System of claim 1 wherein said cooling water is obtained from a river.

6. The Modular Integrated Cooling and Heating System of claim 1 including air vent connections extending between each two of said tanks.

7. The Modular Integrated Cooling and Heating System of claim 1 including overflow passageways extending between each two of said tanks.

8. The Modular Integrated Cooling and Heating System of claim 1 including discharge pipe means extending from the last of said mixing tanks.

9. The Modular Integrated Cooling and Heating System of claim 1 including self-contained, convoluted piping in said first tank constituting said supply means wherein the hot water is not permitted to mix with the cold water in said first tank and second supply means to transport the hot water from said convoluted piping to said second mixing tank.

* * * * *